United States Patent [19]

Coleman

[11] Patent Number: 4,554,952

[45] Date of Patent: Nov. 26, 1985

[54] SEVERING APPARATUS FOR A LOOM

[76] Inventor: Gerald E. Coleman, 918 Devenger Rd., Greer, S.C. 29651

[21] Appl. No.: 567,275

[22] Filed: Dec. 30, 1983

[51] Int. Cl.[4] ..... D03D 49/70

[52] U.S. Cl. ..... 139/302; 139/263; 83/600

[58] Field of Search ..... 139/302, 303, 263–268, 139/291 C, 429; 26/10.4; 83/600–607, 597

[56] References Cited

U.S. PATENT DOCUMENTS 2,012,713 8/1935 Dodge ..... 139/303
2,846,002 8/1958 Farmwald et al. ..... 83/600 X
3,014,504 12/1961 Pfarrwaller ..... 139/263 X
3,868,977 3/1975 Flamand ..... 139/302

FOREIGN PATENT DOCUMENTS 1372172 10/1974 United Kingdom ..... 139/302

*Primary Examiner*—James Kee Chi
*Attorney, Agent, or Firm*—Bailey & Hardaway

[57] ABSTRACT

A severing device for use on a shuttleless loom comprises scissor sections defining raceways for maintenance of a thrust ball bearings therebetween.

3 Claims, 6 Drawing Figures

FIG. 4
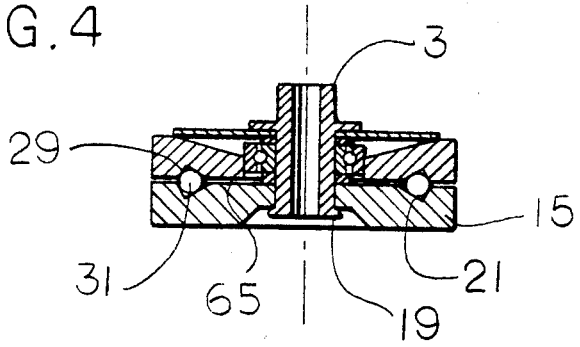
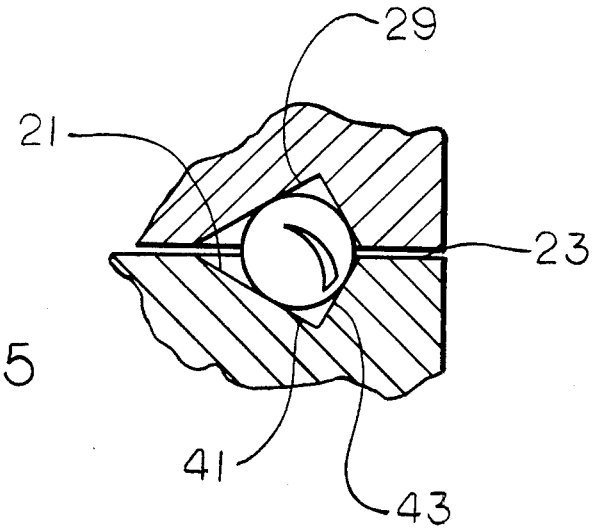
FIG. 5
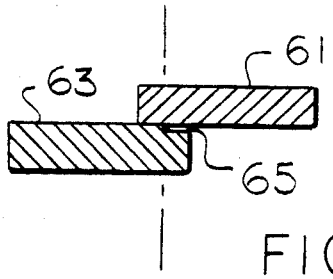
FIG. 6

SEVERING APPARATUS FOR A LOOM

BACKGROUND OF THE INVENTION

This invention relates generally to a device for severing thread in a textile loom and particularly to a device for severing the weft thread of a shuttleless loom.

Heretofore various types of thread severing devices have been known which utilize either scissor action or an anvil and chisel for severing the weft thread of a shuttleless loom. One such device is described in U.S. Pat. No. 3,951,179 to Pfarrwaller. The device described therein has an an object the minimization of wear in such a thread severing device. The disclosure in Pfarrwaller U.S. Pat. No. 3,951,179 is hereby incorporated by reference. The problem pronounced by Pfarrwaller is a persistent problem in all severing devices since such machines tend to severe weft threads at a rate on the order of 200 to 600 severences per minute. It is thus seen that such devices are subjected to considerable wear which was heretofore caused considerable loom down time for maintenance and replacements of worn parts.

SUMMARY OF THE INVENTION

It is thus an object of this invention to provide a severing device for the weft thread of a loom which is not subject to the wear which is brought about with conventional severing mechanisms.

It is a further object of this invention to provide a novel severing device which is operable for periods of time considerable longer than the prior art devices before the need for maintenance arises.

These as well as other object are accomplished by a severing device which comprises two scissor sections which define between them a raceway for placement of ball bearings to thereby eliminate wear between adjacent faces of the scissor sections.

BRIEF DESCRIPTION OF THE DRAWINGS

FIG. 4 is a sectional view along the line 4—4 of FIG. 2.

FIG. 5 is an enlarged break away view of the bearing and raceway on the right side of FIG. 4.

FIG. 6 is a view along the line 6—6 of FIG. 1.

DETAILED DESCRIPTION

In accordance with this invention it has been found that a scissor type severing device may be utilized without the wear and down time normally associated with prior art scissor devices. This lack of wear has been surprisingly found to be brought about by the placement of ball bearings between scissor sections together with bearings between the moveable scissor section and axle therefor. Various other advantages and features will become apparent from a reading of the following description with reference to the various figures and drawings.

Figure 1:
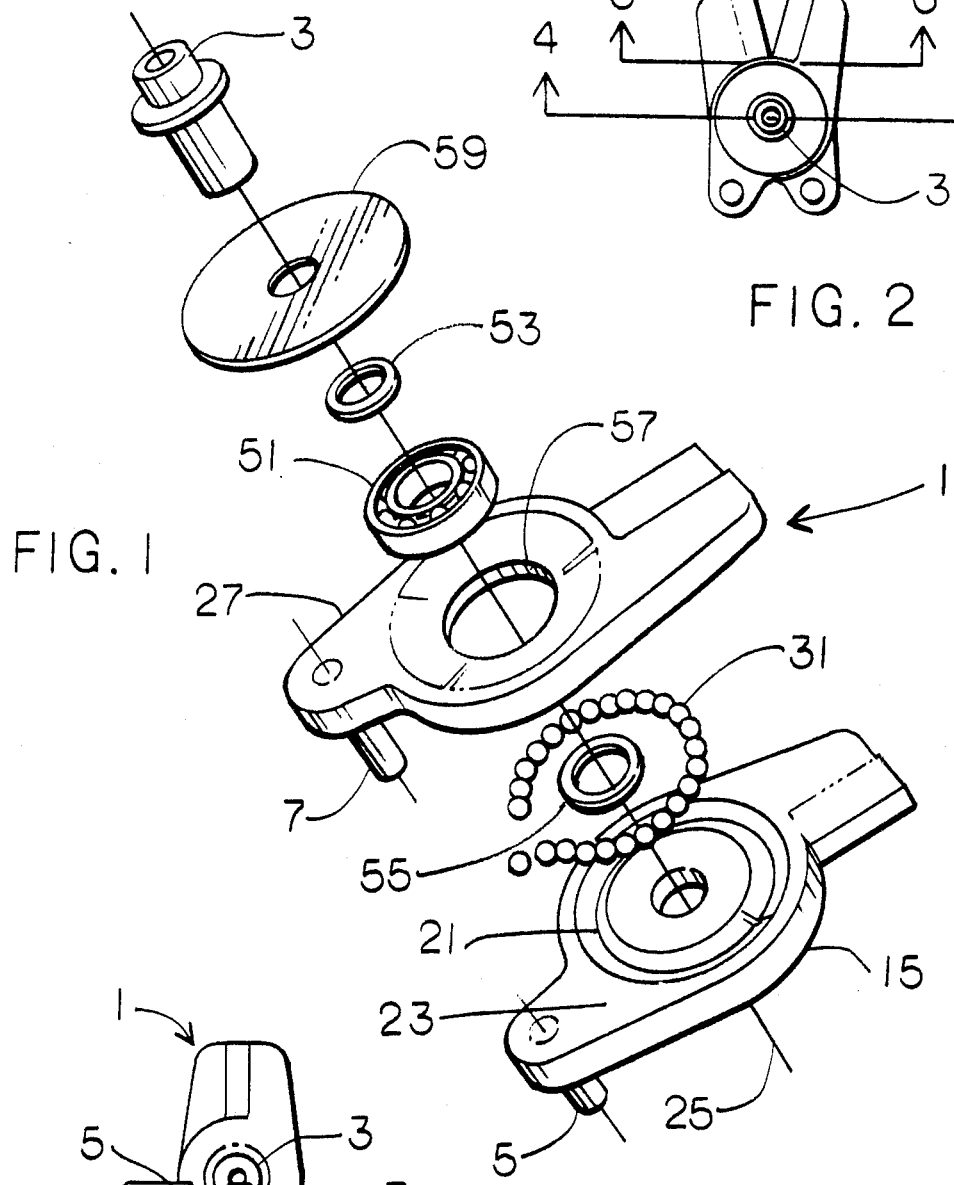
FIG. 1 is an assembly view in perspective of a severing device in accordance with this invention.
Figure 2:
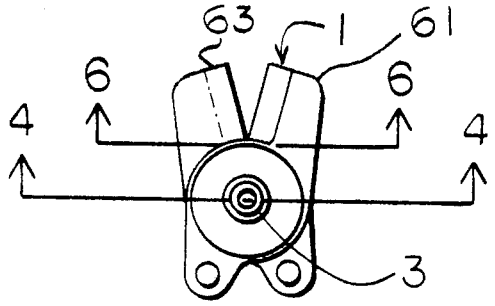
FIG. 2 of the drawings is a plan view of the severing device in accordance with this invention.

FIG. 1 of the drawings illustrates the severing device 1 of this invention in a perspective assembly view, while FIG. 2 illustrates in plan view the severing device and generally illustrates its scissor like characteristics.

Figure 3:
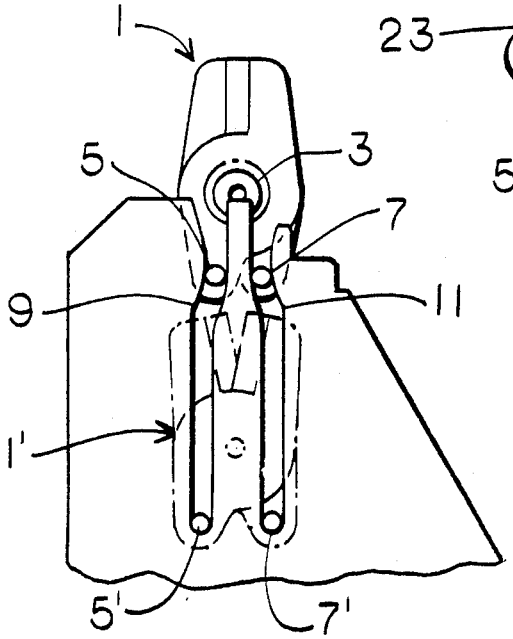
FIG. 3 of the drawings illustrates the severing motion of the device in accordance with this invention.

FIG. 3 of the drawings illustrates the movement associated with the severing device of this invention when the device is installed as a loom component. The severing device is generally utilized on the type of loom described in the above referenced patent to Pfarrwaller which is herewith incorporated by reference. In such instances the axle 3 of the severing device is directly coupled with the machine drive of the loom such that the device 1 as illustrated in FIG. 3 reciprocates vertically from the solid line position of FIG. 3 to the dotted line position indicated at 1' in FIG. 3 whereby followers 5 and 7 ride vertically through slots 9 and 11 such that when the device 1' is at the lowermost position the scissor blades are open and ready to receive thread. Upon movement toward the uppermost vertical extent, the blades begin to close due to the varing distance between slots 9 and 11. Upon reaching the uppermost extent, the scissor blades severe the thread which has crossed between the open scissor blade sections.

Since this device operates in unison with the loom drive mechanism the severing step is carried out at a frequency of approximately 200 to 600 per minute. The potential for wear associated with such movement is apparent but is overcome by the structure to be described with reference to FIG. 1. Other means for initiating scissor action may be provided such as cam action but the frequency of severing action remains at a high level.

The wear minimization within the severence device of this invention comprises a stationary scissor section 15 which is fixedly attached to axle 3 as can best be seen in FIG. 4 by rivoting thereto at 19. Stationary scissor section 15 defines a groove 21 in the inner surface 23 thereof. Groove 21 is generally concentric with the axis 25 of axle 3.

A rotable scissor section 27 is rotable about axis 3 and has a mating groove therein 29 which abuts and mates with the complimentary groove 21 whereby the two grooves form a raceway between the two scissor sections. Ball bearings 31 fill the raceway and thus generally prevent wear by preventing abutting surfaces from rubbing and providing a rolling relationship therebetween. This is best illustrated in FIG. 4.

A highly preferred feature of this invention comprises the formation of grooves 21 and 29 such that each comprises two surfaces such as 41 and 43 which intersect the inner surface such as 23 at differing angles. The utilization of differing angles causes the ball bearing to move in a spiraling manner whereby wear is evenly distributed and does not result in any flattening of surfaces upon the ball bearings.

Additionally a ball bearing casing 51 is provided between rotable scissor section 27 and axle 3. Shims 53 and 55 are illustrated for housing the bearing case within the inner surface 57 of rotable scissor section 27. The utilization of a disc spring 59 is preferred in order to maintain some resiliency between the scissor sections and to thus permit ball bearings 31 to act as thrust bearings between the two surfaces.

In order to give some guidance as to the specifics of the structure, it is preferred that surface 21 intersect the extended intersurface 23 at an angle of 53 degrees while surface 43 intersects at an angle of about 40 degrees to maintain an eighth inch diameter ball bearing therein.

It has been found that the structure above described may be utilized on a shuttleless loom for many hours of operations in excess of that provided by prior art devices without experiencing deleterious wear. As many variations will become apparent to those that are skilled in the art from the reading of the above exemplarily disclosure such modification are included within the spirit and scope of this invention as defined by the following appended claims.

FIG. 6 illustrates the structure of blades 61 and 63 so as to overcome the gap 65 between surface 23 and lower surface of section 27.

What is claimed is:

1. A severing device for the weft thread of a loom, comprising:

an axle;

a stationary scissor section fixed to said axle, said stationary scissor section defining a generally circular groove about and concentric with the axis of said axle;

a rotable scissor section rotably mounted on said axle, said rotable scissor section defining a circular groove to mate with said circular groove of said stationary scissor section whereby adjacent grooves define a raceway; and ball bearings within said raceway between said scissor sections to act as thrustbearing to minimize wear at adjacent inner scissor faces.

2. This severing device according to claim 1 further including ball bearings between said rotable scissor section and said axle.

3. This severing device according to claim 1 wherein each of said grooves is formed by the intersection of two surfaces each of which intesects the inner scissor face at different angles.

* * * * *